US005384223A

United States Patent [19]

Listigovers et al.

[11] Patent Number: 5,384,223

[45] Date of Patent: Jan. 24, 1995

[54] PHOTOCONDUCTIVE IMAGING MEMBERS WITH POLYMER BINDERS

[75] Inventors: Nancy A. Listigovers, Oakville; Trevor I. Martin, Burlington, both of Canada; Sharon E. Normandin, Macedon; Kathleen M. Carmichael, Williamson, both of N.Y.; Gordon K. Hamer, Mississauga, Canada; Donald P. Sullivan, Rochester, N.Y.

[73] Assignee: Xerox Corporation, Stamford, Conn.

[21] Appl. No.: 84,107

[22] Filed: Jul. 1, 1993

[51] Int. Cl.[6] ..... G03G 5/05

[52] U.S. Cl. ..... 430/59; 430/96

[58] Field of Search ..... 430/58, 59, 64, 69, 430/96

[56] References Cited

U.S. PATENT DOCUMENTS 4,587,189 5/1986 Hor et al. ..... 430/59

4,780,385 10/1988 Wieloch et al. ..... 430/69

OTHER PUBLICATIONS

Makromol. Chem. 183,3099–3107 (1982), "Synthesis of AB and BAB Poly(styrene-$\beta$-4-vinylpyridine) and Solution Properties of Their Quaternized Compounds", Koji Ishizu et al.

Journal of Coatings Technology, vol. 58, No. 736, May 1986, pp. 71–82, "Use of A–B Block Polymers as Dispersants For Non-Aqueous Coating Systems", Henry L. Jakubauskas.

*Primary Examiner*—John Goodrow

*Attorney, Agent, or Firm*—E. O. Palazzo

[57] ABSTRACT

A photoconductive imaging member comprised of a supporting substrate, a photogenerating layer comprised of photogenerating pigments dispersed in a polystyrene/polyvinyl pyridine ($A_n$-$B_m$) block copolymer wherein n represents the degree of polymerization of A and m represents the degree of polymerization of B, and a charge transport layer.

34 Claims, No Drawings

PHOTOCONDUCTIVE IMAGING MEMBERS WITH POLYMER BINDERS

BACKGROUND OF THE INVENTION

This invention is generally directed to imaging members, and electrostatographic imaging and printing processes thereof. More specifically, the present invention is directed to layered imaging members wherein there is selected, especially for the photogenerating pigments, a block copolymer, dispersant. In one embodiment of the present invention, there are provided layered photoconductive imaging members with excellent xerographic properties, inclusive of high charge acceptance, low dark decay, high photosensitivity in the wavelength regions of from about 400 to about 800 nanometers, enabling their selection for electrophotographic, especially xerographic, imaging systems and printers. In one embodiment of the invention of the present application, there are provided imaging members with photoconductive layers comprised of known photogenerating pigments dispersed in block copolymers, such as A-B block copolymers, like polystyrene/vinylpyridine block copolymers, and charge or hole transport layers, especially those comprised of aryl amines, which members are sensitive to light in the wavelength region of from about 400 to about 820 nanometers, depending on the photogenerating pigment selected. The resulting members can thus be responsive to illumination of, for example, from about 660 to about 720 nanometers originating from laser diodes printing apparatuses. The photoresponsive imaging members of the present invention can, for example, contain situated between the supporting substrate and the charge transporting layer, a photogenerating layer.

The photogenerating layer can be comprised of a photosensitive pigment, such as benzimidazole perylene (BZP), reference U.S. Pat. No. 4,587,189, the disclosure of which is totally incorporated herein by reference, in a resinous binder. To effectively permit coating of the photogenerating layer or binder generator layer (BGL) on the supporting substrate, it is usually necessary to dissolve the polymeric binder in a solvent suitable for coating, and disperse the photogenerator pigment in the solvent/binder mixture. Submicron size pigment particles are desired which often requires extensive grinding of the mixture in a ball mill or attritor. Large pigment particles due to inefficient grinding or reflocculation are undesirable since they result in coating defects which subsequently surface as print defects. Therefore, it is of importance that the dispersion once formed remain stable for a minimum of about seven to about 14 days to allow completion of the coating. For example, dip coating would require the dispersion to remain stable for a period of months, for example up to seven months. When BZP is dispersed in commercially available binder resins, such as polycarbonates, polyesters, and polyvinylcarbazoles, some settling or flocculation is evident within about 24 hours.

The addition of certain A-B diblock copolymers to a pigment, prior to milling, can provide superior dispersion, reference H. L. Jakubauskas, *Journal of Coatings Tech.*, Vol. 58, No. 736, pages 71 to 82, 1986. The A block acts as an anchor on the pigment surface, while the B block extends out from the surface to pro vide steric stabilization. However, these types of materials cannot usually be incorporated into the binder generator layer (BGL) without adversely affecting the sensitivity, dark decay and cyclic stability of the resulting photoreceptor device. The block copolymer dispersants of this invention enable improved imaging member sensitivity, and excellent dark decay when compared to control devices, or imaging members with a MAKROLON ® polycarbonate binder, or the specific aforementioned diblocks of the prior art. In addition, with the block copolymers of the present invention, the excellent cyclic stability characteristic of, for example, a BZP photoreceptor was not compromised.

Advantages achievable with the imaging members of the present invention include excellent photogenerating pigment dispersion, stable dispersion in the block copolymer, design of the A-B block copolymer wherein the length and composition of the A segment enables it to bind or anchor firmly to the photogenerating pigment surface, while the B segment functions as a steric stabilizer to prevent reflocculation of the photogenerating pigment after dispersion. More specifically, BZP dispersions produced with the A-B block copolymers of this invention are stable in excess of one year, for example about 1.5 years, in embodiments and enable photogenerator layer coatings with substantially reduced defect levels when compared to the binders indicated here. In addition, these block copolymers function both as the dispersant and the binder. Alternatively, they can be used in combination with a compatible binder resin if desired.

Certain layered imaging members are known, including those comprised of separate generating layers, and transport layers as described in U.S. Pat. No. 4,265,990, the disclosure of which is totally incorporated herein by reference; and overcoated photoresponsive materials containing a hole injecting layer overcoated with a hole transport layer, followed by an overcoating of a photogenerating layer; and a top coating of an insulating organic resin, reference U.S. Pat. No. 4,251,612. Examples of photogenerating layers disclosed in these patents include trigonal selenium and phthalocyanines, while examples of transport layers include certain aryl diamines as mentioned therein.

The following United States patents are mentioned: U.S. Pat. No. 4,299,896 which discloses imaging members with a photosensitive layer selected from the disazo pigments of the formulas illustrated, for example, in the Abstract, and in column 2; U.S. Pat. No. 4,314,015 wherein the disazo pigments for the imaging member are of the formula as illustrated in the Abstract, for example, and column 2; U.S. Pat. No. 4,666,810 wherein the azo pigments are illustrated in column 2 for example; and U.S. Pat. No. 4,797,337 wherein the disazo photogenerating pigment is of the formula as illustrated in the Abstract, for example, which disazos may contain a $SO_2$ group.

The use of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. In U.S. Pat. No. 4,587,189, the disclosure of which is totally incorporated herein by reference, there is illustrated a layered imaging member with a bis perylene pigment photogenerating component.

Additional references illustrating layered organic electrophotographic photoconductor elements with azo, bisazo, and related compounds include U.S. Pat. No. 4,390,611, U.S. Pat. No. 4,551,404, U.S. Pat. No. 4,596,754, Japanese Patent 60-64354, U.S. Pat. Nos. 4,400,455, 4,390,608, 4,327,168, 4,299,896, 4,314,015, 4,486,522, 4,486,519, 4,555,667, 4,440,845, 4,486,800, 4,309,611, 4,418,133, 4,293,628, 4,427,753, 4,495,264, 4,359,513, 3,898,084, 4,830,944, 4,820,602, and Japanese Patent Publication 60-111247.

U.S. Pat. No. 4,755,443 discloses a photoreceptor for electrophotography which comprises a charge carrier generating material and charge transport material wherein one charge generating material is a metal phthalocyanine or a metal-free phthalocyanine. The layer containing the generator material also contains an organic amine. Other carrier generating substances can be used in combination with the phthalocyanine generator material, including azo pigments, anthraquinone dyes, perylene dyes, polycyclic quinone dyes, and methine stearate pigments.

Illustrated in copending patent application U.S. Serial No. 084,106 filed concurrently herewith, the disclosure of which is totally incorporated herein by reference, is a process for the preparation of a photogenerating composition which comprises mixing titanyl phthalocyanine Type IV with an AB block copolymer, such as polystyrene-4-vinyl pyridine in a suitable solvent.

U.S. Pat. No. 4,424,266 discloses an electrophotographic photosensitive element having a conductive support and a photosensitive layer comprising a carrier generating phase layer containing a carrier generating material selected from the group consisting of perylene dyes, polycyclic quinones, and azo dyes, and a carrier transporting phase layer containing a hydrazone carrier transporting material. The carrier generator materials can be used either singly or in combination.

U.S. Pat. No. 4,882,254, the disclosure of which is totally incorporated herein by reference, discloses a layered photoresponsive imaging member which comprises a supporting substrate, a photogenerator layer comprising a mixture of first and second pigments, and an aryl amine hole transport layer. The mixture of pigments is selected from perylenes and phthalocyanines, polycyclic quinones and phthalocyanines, or perinones and phthalocyanines.

Photoresponsive imaging members containing perinone and perylene compounds are also known. For example, European Patent Publication 0040402, DE3019326, filed May 21, 1980, discloses the use of N,N'-disubstituted perylene-3,4,9,10-tetracarboxyldiimide pigments as photoconductive substances.

Imaging members with phthalocyanine materials are also known as disclosed in, for example, U.S. Pat. Nos 3,594,163, 3,657,272, 3,816,118, 3,862,127, 3,903,107, 3,927,026, 3,932,180, 3,932,454, 4,031,109, 4,098,795, and U.S. Pat. No. Re. 27,117, the disclosures of each of which are totally incorporated herein by reference.

SUMMARY OF THE INVENTION

It is an object of the present invention to provide layered imaging members with many of the advantages illustrated herein.

Another object of the present invention is to provide block copolymer dispersants for layered photoconductive imaging members.

In another object of the present invention there are provided photoconductive imaging members which are sensitive to visible light from about 400 to about 700 nanometers.

Another object of the present invention resides in the provision of layered photoresponsive imaging members which can possess excellent dark decay properties, high charge acceptance values, and electrical stability.

Further, in another object of the present invention there are provided photoconductive imaging members that can be responsive to radiation from laser diode devices.

Additionally, another object of the present invention resides in the provision of imaging and printing methods with the photoconductive imaging members illustrated herein.

In another object of the present invention there are provided layered imaging members with components that possess excellent dispersion in block copolymer resin binders, and wherein, for example, the photogenerating pigments do not settle on standing, for example, even after 10 months. Settling, if due to flocculation, can lead to large, greater than 10 microns in diameter ($>10$ μm), pigment particles deposited on the BGL which can result in print defects.

In embodiments thereof, the present invention relates to multilayered imaging members. More specifically, the present invention is directed to photoconductive imaging members comprised of a supporting substrate, a photogenerating layer, and a charge transport layer, and wherein the resin binder for the photogenerating layer is comprised of a certain block copolymer.

In embodiments, there is provided a layered photoresponsive member comprised of a supporting substrate, a photogenerating layer comprised of photogenerating pigments, like perylenes, reference U.S. Pat. No. 4,587,189, the disclosure of which is totally incorporated herein by reference, which pigments are dispersed in certain A-B block copolymers, and in contact therewith a charge transport layer. Also, in embodiments there are provided in accordance with the present invention processes for the preparation of the block copolymers selected.

Examples of block copolymers include polystyrene/polyvinyl pyridines of the formula ($A_n$–$B_m$), wherein A is the anchoring block, B is the steric stabilizing block, and n represents the degree of polymerization of A, such as a number of from 7 to about 50, such as 4-vinylpyridine, and m represents the degree of polymerization of B, and can be a number of from about 70 to about 800 like styrene with compositional ratios of the 4-vinylpyridine to styrene in the range of from about 5/95 to about 30/70, and more preferably in the range of from about 8/92 to about 20/80. These copolymers have molecular weights in the range of from about 5,000 to about 100,000 with the preferred range being from about 8,000 to about 35,000.

Specific examples of block copolymers that may be selected for layered photoconductive imaging members include styrene/4-vinylpyridine, and more specifically polystyrene/poly-4-vinylpyridine, preferably with a $M_w$ of from about 10,500 to about 30,000 in embodiments, and a $M_n$ preferably of about 8,000 to about 25,000. Alternative anchoring blocks to poly(4-vinylpyridine) include poly(2-vinylpyridine), modified poly(glycidyl methacrylate), poly[p-(dimethylaminomethyl)styrene], poly(N-ethyl-2-vinylcarbazole), modified poly(allyl methacrylate), poly(methacrylic acid), poly(4-vinylbiphenyl), poly(aryl vinylsulfone), poly(alkyl vinylsulfone), and poly(9-acrylolycarbazole). Alternative steric stabilizing blocks to polystyrene include polymethacrylates, such as polymethylmethacrylate, polybutadiene, poly(styrene-co-butadiene), copolymers of methacrylate mixtures, as methylmethacrylate/butylmethacrylate copolymers, and polyesters. The AB block copolymers are selected in various effective amounts, such as from about 20 to about 50, and preferably from about 30 to about 40 volume percent or volume of the photogenerating layer.

The block copolymers can be synthesized by anionic polymerization, reference the processes as illustrated in K. Ishizu, Y. Kashi, T. Fujutomi, T. Kakurai, *Makrornol. Chem.*, 183, pages 3090 to 3107 (1982), the disclosure of which is totally incorporated herein by reference. For example, anionic polymerization of styrene-b-4-vinylpyridine can be accomplished at a temperature of from about −10° C. to about −50° C. in solvents like tetrahydrofuran (THF) by initiation of styrene monomer with the α-methylstyryl anion generated from α-methylstyrene and a component like n-butyllithium (n-BuLi). Reaction is essentially instantaneous to yield the polystyrene stabilizing block with molecular weights which are easily calculated from the ratio of the total weight of monomer to the number of moles of initiator, and are as indicated herein. The living polystyryl anions are then further reacted with 4-vinylpyridine monomer to provide the desired anchoring block with little or no increase in polydispersity. The reaction is quenched with methanol and precipitated directly into deionized water. After filtering and vacuum drying, the block copolymer is obtained as a white powder in 96 percent yield. One typical styrene/4-vinylpyridine block copolymer contains 10 weight percent of 4-vinylpyridine and 90 weight percent of styrene, as determined by 1H NMR, and has a weight average molecular of 15,000 as determined by GPC. Copolymers with narrow polydispersities, such as for example a molecular weight distribution ($M_wM_n$) of less than about 1.2, can be selected. Composition and molecular weight of the copolymers can be controlled and determined by the weight of monomers used in the reaction and the stoichiometric ratio of the α-methylstyryl anion to the styrene and 4-vinylpyridine monomers. For example, if 90 grams of styrene are polymerized followed with 10 grams of 4-vinylpyridine, the final copolymer will contain 10 weight percent of 4-vinylpyridine. When 1 millimol of initiator is used to polymerize the 100 grams of monomer, then the molecular weight measured by GPC will be in the range of 100,000.

In a specific illustrative embodiment, the photoresponsive imaging member can be comprised of (1) a supporting substrate, (2) a hole blocking layer, (3) an optional adhesive interface layer, (4) a photogenerating layer comprised of a photogenerating pigment or mixtures thereof dispersed in the block copolymer illustrated herein, and (5) a charge transport layer. Thus, a specific photoresponsive device of the present invention can be comprised of a conductive supporting substrate, a hole blocking metal oxide layer in contact therewith, an adhesive layer, a photogenerating layer comprised of cis trans perylenes, metal phthalocyanines, metal free phthalocyanines, vanadyl phthalocyanine, titanyl phthalocyanines, and preferably benzimidazole perylene (BZP) comprised of the trans and cis isomers, respectively, preferably as a 50:50 mixture, and generally from about 30 to 70 of the cis and 70 to 30 of the trans, bisbenzimidazo[2,1-a:2',1'-a']anthra[2,1,9-def:6,5,10-d'e'f']diisoquinoline-10,21-dione and bisbenzimidazo[2,1-a:1',2'-b']anthra[2,1,9-def:6,5,10-d'e'f']diisoquinoline-6,11-dione; and as a top layer a hole transport layer comprised of certain diamines dispersed in a resinous matrix. The photogenerating layer, when in contact with the hole transport layer, is capable of allowing holes generated by the photogenerating layer to be transported. Examples of aryl amine hole transport molecules that may be selected for the photoconductor devices are illustrated in U.S. Pat. No. 4,265,990, the disclosure of which is totally incorporated herein by reference. Also, examples of charge transport molecules are illustrated in U.S. Pat. No. 4,921,773 and the patents mentioned therein, the disclosures of each of the aforementioned patents, including the '773 patent, being totally incorporated herein by reference.

The photoresponsive devices described herein can be incorporated into various imaging systems such as those conventionally known as xerographic imaging processes. Additionally, the imaging members of the present invention can be selected for imaging and printing systems with near red and/or infrared light. In this embodiment, the photoresponsive devices may be negatively or positively charged, exposed to light in a wavelength of from about 700 to about 820, and preferably 740 to 800 nanometers, either sequentially or simultaneously, followed by developing the resulting image and transferring to paper. Additionally, the imaging members of the present invention can be selected for imaging and printing systems with visible light. In this embodiment, the photoresponsive devices may be negatively or positively charged, exposed to light in a wavelength of from about 400 to about 700 nanometers, followed by development with a known toner, transfer, and fixing.

DESCRIPTION OF SPECIFIC EMBODIMENTS

Specific embodiments of the invention will now be illustrated, it being noted that substantially equivalent imaging members are also embraced within the scope of the present invention.

A photoconductive imaging member of the present invention comprises a supporting substrate, a photogenerating layer comprised of the cis trans BZP perylene, reference U.S. Pat. No. 4,587,189, dispersed in a styrene/4-vinylpyridine copolymer, and a charge carrier hole transport layer, which comprises hole charge transporting molecules dispersed in an inactive resinous binder composition.

The hole transport layer can be situated between the supporting substrate and the photogenerating layer. More specifically, there is envisioned in the order stated a photoconductive imaging member comprising a supporting substrate, a hole transport layer comprising aryl amine hole transport molecules dispersed in an inactive resinous binder composition, and a photogenerating layer of BZP dispersed in polystyrene/poly-4-vinylpyridine.

A photoconductive imaging member of the present invention can also be comprised of a supporting substrate, a photoconductive layer with styrene/4-vinylpyridine copolymer binder, and a transport layer comprised of aryl diamine molecules dispersed in a MAKROLON ® polycarbonate binder.

The supporting substrate of the imaging members may comprise an insulating material such as an inorganic or organic polymeric material, including MYLAR ®, a commercially available polymer, and titanized MYLAR ®; a layer of an organic or inorganic material having a semiconductive surface layer such as indium tin oxide or aluminum arranged thereon; or a conductive material such as aluminum, titanium, chromium, nickel, brass, or the like. The substrate may be flexible, seamless, or rigid and may have a number of different configurations, such as a plate, a cylindrical drum, a scroll, an endless flexible belt, and the like. In one embodiment, the substrate is in the form of an endless flexible belt. In some situations, it may be desirable to coat an anticurl layer, such as polycarbonate materials commercially available as MAKROLON ® from Farbenfabricken Bayer AG, on the back of the substrate, particularly when the substrate is an organic polymeric material.

The thickness of the substrate layer depends on a number of factors, including economic considerations, the components of the other layers, and the like. Thus, this layer may be of substantial thickness, for example up to 125 mils, or of minimal thickness provided that there are no adverse effects on the resulting imaging device or process. In embodiments, the thickness of this layer is from about 3 mils to about 20 mils.

Generally, the photogenerating or photoconductive layer has a thickness of from about 0.05 micron to about 25 microns or more, and preferably from 1 to about 5 microns. The thickness of the polymeric charge generation layer is dependent primarily on the wavelength of the incident light. For example, when xerographic imaging is accomplished using visible light (400 to 700 nanometers range) where these polymers are strongly absorbing, thin generation layers, about 0.2 to 2 microns, are selected when near infrared light, as produced by solid state lasers near 780 nanometers, is used for imaging, thicker generation layers, typically 5 to 30 microns, may be selected. Generally, it is desirable to provide this layer in a thickness sufficient to absorb a substantial amount, for example from about 80 to about 90 percent or more, of the incident radiation which is directed upon it in the imagewise or printing exposure step. The maximum thickness of this layer is also dependent upon factors such as mechanical considerations, the thicknesses of the other layers, and whether a flexible photoconductive imaging member is desired.

The charge transport layer can be comprised of various components providing, for example, that they effectively transport charges (holes) such as an aryl amine compound dispersed in a resinous binder and other components, reference the '773 patent mentioned herein, the disclosure of which is totally incorporated herein by reference, and U.S. Pat. No. 4,933,245, the disclosure of which is totally incorporated herein by reference. In one embodiment, the charge transport layers are comprised of aryl amine compounds of the formula

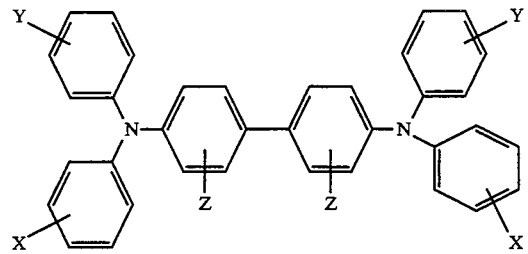

wherein X, Y and Z are selected from the group consisting of hydrogen, an alkyl group with, for example, from 1 to about 25 carbon atoms such as methyl, ethyl, propyl, isopropyl, and the like, and a halogen preferably chlorine, and at least one of X, Y and Z is independently an alkyl group or chlorine. When Y and Z are hydrogen, the amine is N,N'-diphenyl-N,N'-bis(alkylphenyl)-[1,1'-biphenyl]-4,4'-diamine wherein the alkyl is, for example, methyl, ethyl, propyl, n-butyl, or the like, or N,N'-diphenyl-N,N'-bis(chlorophenyl)-[1,1'-biphenyl]-4,4'-diamine. Preferably, X is selected from the group consisting of methyl and chloride in either the ortho, meta, or para positions. Compounds corresponding to the above formula include N,N'-diphenyl-N,N'-bis(alkylphenyl)-[1,1'-biphenyl]-4,4'-diamine, wherein alkyl is selected from the group consisting of methyl, such as 2-methyl, 3-methyl and 4-methyl, ethyl, propyl, butyl, hexyl, and the like. With halo substitution, the amine is N,N'-diphenyl-N,N'-bis(halo phenyl)-[1,1'-biphenyl]-4,4'-diamine, wherein halo is 2-chloro, 3-chloro or 4-chloro. Other electrically active small molecules which will transport holes include bis(4-diethylamino-2-methylphenyl)phenyl methane, 4',4''-bis(diethylamino)-2',2''-dimethyltriphenyl methane, bis-4-(diethylaminophenyl)phenyl methane, and 4,4'-bis(diethylamino)-2,2'-dimethyltriphenyl methane. Generally, the hole transport layer has a thickness of from about 5 to about 75 microns, and preferably of from about 10 to about 40 microns.

Other transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole transporting materials, include the following:

Hole transport molecules of the type described in U.S. Pat. Nos. 4,306,008; 4,304,829; 4,233,384; 4,115,116; 4,299,897; 4,081,274 and 5,139,910 (D/90394), the disclosures of each of which are totally incorporated herein by reference, can be selected for the imaging members of the present invention in embodiments. Typical diamine hole transport molecules include N,N'-diphenyl-N,N'-bis(3-methylphenyl)-(1,1'-biphenyl)-4,4'-diamine, and the like.

Pyrazoline transport molecules as disclosed in U.S. Pat. Nos. 4,315,982; 4,278,746 and 3,837,851, the disclosures of each of which are totally incorporated herein by reference, can also be selected in embodiments. Substituted fluorene charge transport molecules as described in U.S. Pat. No. 4,245,021, the disclosure of which is totally incorporated herein by reference, can also be selected in embodiments.

Oxadiazole transport molecules, such as 2,5-bis(4-diethylaminophenyl)-1,3,4-oxadiazole, pyrazoline, imidazole, triazole, and the like, may also be selected as charge transport molecules in embodiments. Other typical oxadiazole transport molecules are described, for example, in German Patents 1,058,836; 1,060,260 and 1,120,875, the disclosures of each of which are totally incorporated herein by reference, and can also be selected in embodiments.

Other specific hole transports include hydrazone transport molecules, such as p-diethylamino benzaldehyde-(diphenylhydrazone), 4-methoxynaphthlene- 1 -carbaldehyde, 1 -methyl- 1 -phenylhydrazone, and the like. Other typical hydrazone transport molecules are described, for example, in U.S. Pat. Nos. 4,150,987; 4,385,106; 4,338,388; 4,387,147; 4,256,821 and 4,297,426, the disclosures of each of which are totally incorporated herein by reference.

Examples of highly insulating and transparent resinous components or inactive binder resinous material that may be selected for the transport layer include components such as those illustrated in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. The materials most preferred as electrically inactive resinous materials in embodiments of the present invention are poly(4,4'-dipropylidine-diphenyline carbonate) with a weight average molecular weight of from about 35,000 to about 40,000, available as LEXAN 145 TM from General Electric Company; poly(4,4'-isopropylidine-diphenyline carbonate) with a weight average molecular weight of from about 40,000 to about 45,000, available as LEXAN 141 TM from General Electric Company; a polycarbonate resin having a weight average molecular weight of from about 50,000 to about 100,000, available as MAKROLON ® from Farbenfabricken Bayer AG; and a polycarbonate having a weight average molecular weight of from about 20,000 to about 50,000, available as MERLON TM from Mobay Chemical Company. Generally, the resinous binder contains from about 10 to about 75 percent by weight of the active material corresponding to the foregoing formula, and preferably from about 35 percent to about 50 percent of this material.

The photoconductive imaging member may optionally contain a hole blocking layer situated between the supporting substrate and the photogenerating layer. This layer may comprise metal oxides, such as aluminum oxide and the like, or materials such as silanes, nylons, and the like. The primary purpose of this layer is to prevent hole injection from the substrate during and after charging. Typically, this layer is of a thickness of about 5 to about 300 Angstroms, although it may be as thick as 2 microns in some instances.

In addition, the photoconductive imaging member may also optionally contain an adhesive interface layer situated between the hole blocking layer and the photogenerating layer. This layer may comprise a polymeric material, such as polyvinyl chloride, polymethacrylates, certain polyesters like Goodyear 49,000, and the like. Typically, this layer is, for example, of a thickness of less than about 0.6 micron with a thickness range of from about 0.05 to about 1 micron being suitable in embodiments of the present invention.

Imaging members of the present invention exhibit excellent xerographic properties in embodiments thereof. For example, values for dark development potential ($V_{ddp}$) can range from about −400 volts to about −975 volts provided, for example, that the aforementioned hole transporting layers are used in conjunction with the charge generating pigments dispersed in the block copolymers, or provided, for example, that the charge generating polymers are used as single layer photoconductors of from about +400 volts to about +975 volts if the aforementioned hole transporting layers are used in conjunction with the charge generating polymers in an inverted mode where the hole transporting layer is sandwiched between the charge generating polymer layer and the substrate material, or when the charge generating polymers are used as single layer photoconductors. Preferred ranges for dark development potential for the imaging members of the present invention are usually from about −400 to about −900 or about +400 to about +900 volts, respectively, with −800 or +800 volts, respectively, being especially preferred in embodiments. High dark development potentials permit high contrast potentials, which result in images of high quality with essentially no background development.

The imaging members of the present invention in embodiments thereof also exhibit low dark decay values of, for example, about 50 volts per second or less. Low dark decay values can be of importance for developing high quality images since dark decay measures the amount of charge that disappears after charging of the photoreceptor, and a large difference in charge between exposed and unexposed areas of the photoreceptor results in images with high contrast. Acceptable values for dark decay vary depending on the design of the imaging apparatus in which the imaging members are contained. This dark decay may be as high as 100 volts per second with 50 volts and 10 to 20 volts per second being preferred in embodiments.

Residual potential values ($V_R$) for the imaging members of the present invention in embodiments thereof are excellent, ranging from, for example, about −5 volts to about −50 volts or about +5 to about +50 volts, respectively. Residual potential is a measure of the amount of charge remaining on the imaging member after erasure by exposure to light and prior to imaging. Residual potentials of −5 to −15 volts or +5 to +15 volts are considered exceptional and preferred.

Photosensitivity values ($E_{0.5ddp}$ at 670 nanometers) for the imaging members of the present invention in embodiments thereof are acceptable and in some instances excellent, and can be, for example, from about 2 to about 25 ergs per square centimeter. Acceptable photosensitivity values vary depending on the design of the imaging apparatus in which the imaging members are contained; thus, in some instances, values as high as 40 or 50 are acceptable, and values of less than about 5 may be preferred.

The present invention also encompasses a method of generating images with the photoconductive imaging members disclosed herein. The method comprises the steps of generating an electrostatic image on a photoconductive imaging member of the present invention, subsequently developing the electrostatic image with known developer compositions comprised of resin particles, pigment particles, additives, including charge control agents and carrier particles, reference U.S. Pat. Nos. 4,558,108; 4,560,535; 3,590,000; 4,264,672; 3,900,588 and 3,849,182, the disclosures of each of these patents being totally incorporated herein by reference, transferring the developed electrostatic image to a suitable substrate, and permanently affixing the transferred image to the substrate. Development of the image may be achieved by a number of methods, such as cascade, touchdown, powder cloud, magnetic brush, and the like. Transfer of the developed image to a substrate may be by any method, including those wherein a corotron or a biased roll is selected. The fixing step may be performed by means of any suitable method, such as flash fusing, heat fusing, pressure fusing, vapor fusing, and the like.

The imaging members of the present invention can be prepared by a number of different known processes, such as those illustrated in copending application U.S. Serial No. 07/617,234 now abandoned, the disclosure of which is totally incorporated herein by reference. In one process embodiment, the photogenerator pigment with resin binder is coated onto a supporting substrate with a Bird applicator, for example, followed by the solution coating of the charge transport layer, and thereafter drying in, for example, an oven.

The following Examples are being supplied to further define various species of the present invention, it being noted that these Examples are intended to illustrate and not limit the scope of the present invention. Parts and percentages are by weight unless otherwise indicated. Comparative Examples are also provided.

SYNTHESIS OF STYRENE-b-4-VINYLPYRIDINE COPOLYMERS

General Experimental:

All syringes and syringe needles were dried in an oven at 125° C., and cooled in a desiccator containing calcium chloride. Tetrahydrofuran was dried over and distilled from sodium/benzophenone under an argon atmosphere. Styrene and α-methylstyrene were vacuum distilled from sodium hydride and stored under a blanket of argon. 4-Vinylpyridine was vacuum distilled from calcium hydride and stored under a blanket of argon. N-butyllithium, in cyclohexane, was used as received from Aldrich Chemical and titrated with diphenylacetic acid, just prior to use. All reactions were accomplished with a Buchi Type 1 Autoclave fitted with a 1 liter kettle. The reaction kettle was flushed with argon gas and dried using a solution of n-butyllithium. Throughout the synthesis of the copolymer, a positive pressure of argon was maintained in the reaction kettle.

Preparation of Styrene-b-4-vinylpyridine Copolymers:

To the reactor kettle was added dry tetrahydrofuran (500 milliliters), followed by cooling to −50° C. The initiator solution was prepared in a separate pot by the dropwise addition of n-butyllithium (4.0 milliliters, 1.93 molar, 7.7 millimols) to α-methylstyrene (1.0 milliliter, 7.7 millimols) in tetrahydrofuran (25 milliliters). Without delay, a portion of the deep red initiator solution (18 milliliters, 4.6 millimols) was transferred to the reaction kettle followed by styrene monomer (73.8 grams, 709 millimols). There was an immediate color change from red to orange. After 15 minutes, 4-vinylpyridine monomer (8.8 grams, 84 millimols) was added to give a pale orange solution. The bath temperature was raised to −10° C. and the reaction was quenched with methanol. The styrene/4-vinylpyridine block copolymer was precipitated from the reaction mixture by dropwise addition into 6 liters of deionized water. The product was isolated by filtration and dried to constant weight in a vacuum oven at 70° C., to provide a 98 percent yield.

Characterization of Styrene-b-4-vinylpyridine Copolymers:

4-Vinylpyridine and styrene contents were easily identified by 1H NMR, and $M_n$ and $M_w$ were determined by GPC versus polystyrene standards. For the above described copolymer, the 4-vinylpyridine and styrene contents were 10.4 weight percent and 89.6 weight percent, respectively, with $M_n$=19,200 and $M_w$=21,700. A series of copolymers of various molecular weights and composition were prepared by adjusting the millimols of initiator and weight ratios of the two monomers as illustrated in Table 1.

TABLE 1

| Sample No. | Wt. of Styrene Added | Wt. of 4-VP Added | Wt % Styrene Cal'd from $^1$H NMR | Wt % 4-VP Cal'd from $^1$H NMR | Initiator mols[a] | GPC $M_n$ | GPC $M_w$ |
|---|---|---|---|---|---|---|---|
| Example 1 | 26.0 | 6.0 | 81.7 | 18.3 | 2.25 | 15.6 | 18.4 |
| Example 2 | 26.0 | 6.0 | 81.5 | 18.5 | 1.07 | 30.0 | 36.7 |
| Example 3 | 73.6 | 9.0 | 89.7 | 10.3 | 4.46 | 20.2 | 22.8 |
| Example 4 | 27.8 | 4.0 | 87.4 | 12.6 | 1.86 | 17.8 | 21.0 |

[a]The initiator is the α-methylstyryl anion formed by the reaction of α-methylstyrene and n-butyllithium.

DEVICE FABRICATION AND TESTING

Control Device:

A control photoconductive imaging member was prepared by providing a web of titanium coated polyester (MELINEX TM available from ICI Americas Inc.) substrate having a thickness of 3 mils, and applying thereto, with a gravure applicator, a solution containing 50 grams of 3-aminopropyltriethoxysilane, 15 grams of acetic acid, 684.8 grams of 200 proof denatured alcohol and 200 grams of heptane. This layer was then dried for about 5 minutes at 135° C. in the forced air dryer of the coater. The resulting blocking layer had a dry thickness of 500 Angstroms.

An adhesive interface layer was then prepared by applying a wet coating over the blocking layer, using a gravure applicator, containing 3.5 percent by weight based on the total weight of the solution of copolyester adhesive (DuPont 49,000, available from E. I. DuPont de Nemours & Company) in a 70:30 volume ratio mixture of tetrahydrofuran/cyclohexanone. The adhesive interface layer was then dried for about 5 minutes at 135° C. in the forced air dryer of the coater. The resulting adhesive interface layer had a dry thickness of 620 Angstroms.

The adhesive interface layer was thereafter coated with a photogenerating layer (CGL) containing 80 percent by volume benzimidazole perylene and 20 percent by volume of MAKROLON® polycarbonate. This coating solution was prepared by combining 0.8 gram of benzimidazole perylene (BZP) (50/50 mixture of cis and trans isomers), 0.15 gram of MAKROLON® polycarbonate, and 47.5 milliliters of methylene chloride in a 4 ounce bottle, containing 300 grams of stainless steel shot, and roll milling for 4 days. The resulting slurry was, thereafter, applied to the adhesive interface with a Bird applicator to form a layer having a wet thickness of 0.25 mil. The layer was dried at 135° C. for 5 minutes in a forced air oven to form a dry thickness photogenerating layer having a thickness of 0.4 micrometer.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and MAKROLON®, a polycarbonate resin having a molecular weight of from about 50,000 to 100,000 commercially available from Farbenfabriken Bayer A. G. The resulting mixture was dissolved in methylene chloride to form a solution containing 15 percent by weight of solids. This solution was applied on the photogenerator layer using a Bird applicator to form a coating which upon drying had a thickness of 25 microns. During this coating process, the humidity was equal to or less than 15 percent. The resulting photoreceptor device containing all of the above layers was annealed at 135° C. in a forced air oven for 5 minutes and thereafter cooled to ambient room temperature.

Experimental Invention Device:

Imaging members were prepared by repeating the process for preparing the above control device with the exception that various block copolymers, see Table 1, were used as a direct replacement for MAKROLON® polycarbonate in the photoreceptor CGL (charge on photogenerating layer) with toluene as the solvent.

The imaging members prepared were evaluated as follows. The xerographic electrical properties of the imaging members were determined by electrostatically charging the surfaces thereof with a corona discharge source to a surface charge density of $1.2\times10^{-7}$ coulombs/cm$^2$ as measured by a capacitively coupled probe attached to an electrometer. The dark development potential, Vddp, was measured 0.66 seconds after charge using an electrostatic voltmeter with the samples kept in the dark. The sample is then exposed to a xenon arc lamp to discharge the member to residual surface potential of approximately 20 volts. The exposure wavelength was adjusted using interference filters to 670 nanometers. Subsequently, the imaging member was exposed to an erase lamp to photodischarge the surface charge and to determine its residual voltage ($V_R$). Thereafter, the imaging member was charged in a similar manner and exposed to visible radiation at the dark development potential, and the sensitivity of the member was determined in terms of percent discharge at 3.8ergs.

Results:

In three of the six invention device or members tested, the pigment particle size (Horiba) was substantially reduced (0.07 to 0.09 μm) compared to the MAKROLON® control (0.20 to 0.30 μm) (see Table 2). The dispersion stability in three of the six was excellent with no settling after 10 days (see Examples 1, 2 and 3). The MAKROLON® polycarbonate control settled in 24 to 48 hours. These results indicate, for example, that the pyridine unit is an effective anchor for the BZP pigment surface, and also when the $M_w$ of the styrene and vinylpyridine blocks are within a particular range, dispersion stability is excellent. The three which were less effective are illustrated in Comparative Examples 4, 5, and 6.

The copolymer of Comparative Example 4 is similar to Example 1 in symmetry with 19 weight percent of 4-vinylpyridine. However, the molecular weight of Comparative Example 4 is much higher than that of Example 1. The copolymer of Comparative Example 5 has a comparable symmetry to that of Example 2, but a much lower molecular weight. In Comparative Example 6, the $M_w$ is comparable to the $M_w$ of Example 3, however, the symmetry of the molecules are much different. The copolymer of Comparative Example 6 is almost symmetric with a 4-vinylpyridine content of 55 weight percent, while Example 3 is asymmetric. To be an effective stabilizer for BZP dispersions, the styrene-b-4-vinylpyridine copolymer must have an appropriate molecular weight and symmetry. Ideally, the copolymer should be 8 to 20 weight percent of 4-vinylpyridine with a molecular weight in the range of 8,000 to 35,000.

In addition, use of this dispersant as the binder polymer in the BGL did not degrade the electrical properties of the imaging member. The time-zero PIDCs for the nonstabilized and stabilized BZP imaging members are substantially identical.

TABLE 2

| SAMPLE | Particle Size $d_{50} \pm s$ (μm) (Horiba) | Dispersion Stability | $V_{ddp}/V_{bg}$ | % Dark decay | % Discharge (3.8 ergs) | Cyclic Stability % cycle up | Cyclic Stability % cycle down | % 4-vinyl pyr. | $M_2$ |
|---|---|---|---|---|---|---|---|---|---|
| MAKROLON (Control) | 0.20 ± 0.30 | Settles in 24 to 48 hours | 842/473 | 9.2 | 43.8 | 1.1 | 7.4 | NA | NA |
| Example 1 | 0.07 ± 0.06 | No settling after 10 days | 843/449 | 6.9 | 46.7 | 1.2 | 5.3 | 19% | 30K |
| Example 2 | 0.09 ± 0.11 | No settling after 10 days | 938/428 | 8.2 | 54.4 | 1.5 | 4.1 | 9% | 11K |
| Example 3 | 0.08 ± 0.14 | No settling after 10 days | 830/376 | 9.7 | 54.7 | 1.0 | 5.3 | 10% | 15K |
| Example 4 Comparative | 0.38 ± 0.40 | Totally settled within 72 | 809/425 | 6.9 | 47.5 | 0 | 4.6 | 19% | 78K |

TABLE 2-continued

| SAMPLE | Particle Size $d_{50} \pm s$ (μm) (Horiba) | Dispersion Stability | $V_{ddp}/V_{bg}$ | % Dark decay | % Discharge (3.8 ergs) | Cyclic Stability % cycle up | % cycle down | % 4-vinyl pyr. | $M_2$ |
|---|---|---|---|---|---|---|---|---|---|
| | | hours | | | | | | | |
| Example 5 Comparative | 0.13 ± 0.17 | Almost totally settled within 45 hours | 729/303 | 13.2 | 58.4 | 1.1 | 7.4 | 8% | 7K |
| Example 6 Comparative | 0.24 ± 0.38 | Settling apparent within 45 hours | 780/414 | 9.4 | 46.9 | 1.4 | 3.2 | 55% | 16K |

80 weight percent of pigment/binder loading milled in toluene (except control milled in $CH_2Cl_2$), 50 percent of aryl diamine/MAKROLON ®.

Other modifications of the present invention will occur to those skilled in the art subsequent to a review of the present application. These modifications, and equivalents thereof are intended to be included within the scope of this invention.

What is claimed is:

1. A photoconductive imaging member comprised of a supporting substrate, a photogenerating layer comprised of photogenerating pigments dispersed in a polystyrene/polyvinyl pyridine ($A_n$–$B_m$) block copolymer wherein n represents the degree of polymerization of A and m represents the degree of polymerization of B, and a charge transport layer, and wherein said block copolymer has a weight average molecular weight of from about 8,000 to about 35,000.

2. A photoconductive imaging member in accordance with claim 1 wherein the charge transport layer is comprised of hole transport compounds.

3. A photoconductive imaging member in accordance with claim 1 wherein n is a number of from between about 7 to about 50, and A represents the anchoring block for said pigments, and B represents the block that functions primarily as a steric stabilizer; and wherein m is a number of from between about 70 to about 800.

4. A photoconductive imaging member in accordance with claim 1 wherein the photogenerating layer is in contact with and is situated between the supporting substrate and the charge transport layer.

5. A photoconductive imaging member in accordance with claim 1 wherein the charge transport layer is in contact with and is situated between the supporting substrate and the photogenerating layer.

6. A photoconductive imaging member in accordance with claim 1 wherein the photoconductive imaging member includes a metal oxide hole blocking layer in contact with and situated between the supporting substrate and the photogenerating layer.

7. A photoconductive imaging member in accordance with claim 6 wherein the metal oxide is aluminum oxide.

8. A photoconductive imaging member in accordance with claim 6 wherein the metal oxide hole blocking layer has a thickness of from between about 100 and about 500 Angstroms.

9. A photoconductive imaging member in accordance with claim 6 wherein the photoconductive imaging member contains an adhesive interface layer in contact with and situated between the supporting substrate and the metal oxide hole blocking layer.

10. A photoconductive imaging member in accordance with claim 9 wherein the adhesive interface layer comprises a polymeric material.

11. A photoconductive imaging member in accordance with claim 10 wherein the adhesive interface layer has a thickness of from between about 0.1 and about 0.6 micron.

12. A photoconductive imaging member in accordance with claim 1 wherein the supporting substrate is a metal.

13. A photoconductive imaging member in accordance with claim 12 wherein the metal is aluminum, titanium, chromium, or an organic polymeric composition.

14. A photoconductive imaging member in accordance with claim 2 wherein the photogenerating layer has a thickness of from about 0.05 to about 10 microns.

15. A photoconductive imaging member in accordance with claim 1 wherein the hole transport layer comprises an aryl amine compound.

16. A photoconductive imaging member in accordance with claim 15 wherein the aryl amine comprises molecules of the formula

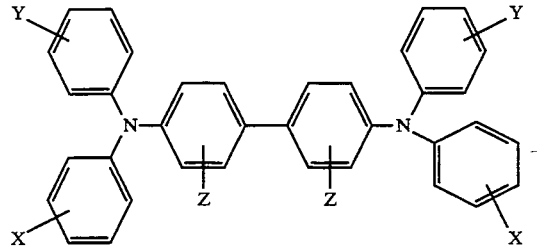

dispersed in a highly insulating and transparent organic resinous binder wherein X, Y and Z are selected from the group consisting of hydrogen, an alkyl group with from 1 to about 25 carbon atoms and a halogen, and at least one of X, Y and Z is independently an alkyl group or a halogen; and wherein said block copolymer is polystyrene/poly-4-vinyl pyridine.

17. A photoconductive imaging member in accordance with claim 16 wherein the resinous binder is a polycarbonate.

18. A photoconductive imaging member in accordance with claim 1 wherein the block copolymer is polystyrene/poly-4-vinylpyridine with a molecular weight of from about 11,000 to about 35,000.

19. A photoconductive imaging member in accordance with claim 1 wherein the photogenerating layer is comprised of a mixture of bisbenzimidazo(2,1-a:1',2'-b')anthra(2,1,9-def:6,5,10-d',e',f') diisoquinoline-6,11-dione and bisbenzimidazo(2,1-a:2',1'-a)anthra(2,1,9-def:6,5,10-d',e',f') diisoquinoline-10,21-dione.

20. A method of imaging comprising the steps of (a) generating an electrostatic image on the photoconductive imaging member of claim 1;

(b) subsequently developing the electrostatic image;

(c) transferring the developed electrostatic image to a suitable substrate; and (d) permanently affixing the transferred image to the substrate.

21. A photoconductive imaging member comprised of a supporting substrate, a photogenerating layer comprised of a mixture of bisbenzimidazo(2,1-a:1',2'-b')anthra(2,1,9-def:6,5,10-d',e',f') diisoquinoline-6,11-dione and bisbenzimidazo(2,1-a:2',1'-a)anthra(2,1,9def:6,5,10-d',e',f') diisoquinoline-10,21-dione dispersed in a polystyrene/poly-4-vinylpyridine binder with a weight average molecular weight of from about 10,800 to about 30,000, and a charge transport layer comprised of aryl amine molecules dispersed in a resin binder.

22. A photoconductive imaging member in accordance with claim 21 wherein the charge transport molecules are N,N'-bis(3''-methylphenyl)-1,1 '-biphenyl-4,4'-diamine.

23. A photoconductive imaging member in accordance with claim 21 wherein the mixture is comprised of about 50 weight percent of the cis isomer and 50 weight percent of the trans isomer.

24. A photoconductive imaging member in accordance with claim 1 wherein the block copolymer is polystyrene/poly-4-vinylpyridine with a number average molecular weight of from about 8,000 to about 25,000.

25. A photoconductive imaging member in accordance with claim 1 wherein the block copolymer is styrene-b-4-vinylpyridine with from about 5 to about 30 percent of vinylpyridine and from about 95 to about 70 percent of styrene, and the photogenerating layer has a thickness of from about 0.1 to about 2 microns.

26. A photoconductive imaging member in accordance with claim 1 wherein A is poly(2-vinylpyridine), poly(glycidylmethacrylate), poly[p-(dimethylamino methyl)styrene], poly(allylmethacrylate) or poly(9-acryloylcarbazole); and the B block is a polymethacrylate or a polyester.

27. A stable imaging member which comprises adding to the photogenerating layer of said member polystyrene/poly-4-vinylpyridine with a molecular weight ($M_w$) of from about 11,000 to about 35,000.

28. A photoconductive imaging member in accordance with claim 1 wherein a stable coating dispersion for generating the photogenerating layer is comprised of said pigments, solvent, and said block copolymer, and wherein said pigments are substantially free of flocculation or settling.

29. A photoconductive imaging member in accordance with claim 1 wherein said polystyrene/polyvinyl pyridine block copolymer is a styrene-b-4-vinylpyridine with a 4-vinylpyridine content of 10.4 weight percent and a styrene content of 89.6 weight percent, and with a number average molecular weight of 19,200 and a weight average molecular weight of 21,700.

30. A photoconductive imaging member in accordance with claim 1 wherein said polystyrene/polyvinyl pyridine block copolymer is styrene-b-4-vinylpyridine with a styrene content of 81.5 percent and a 4-vinylpyridine content of 18.5 weight percent, and with a number average molecular weight of 15,600 and a weight average molecular weight of 18,400;a styrene content of 81.5 weight percent and a 4-vinylpyridine content of 18.5 weight percent, and with a number average molecular weight of 30,000 and a weight average molecular weight of 36,700; a styrene content of 89.7 percent and a 4-vinylpyridine content of 10.3 weight percent, and with a number average molecular weight of 20,200 and a weight average molecular weight of 22,800; or with a styrene content of 87.4 percent and a 4-vinylpyridine content of 12.6 weight percent, and with a number average molecular weight of 17,800 and a weight average molecular weight of 21,000.

31. A photoconductive imaging member in accordance with claim 1 wherein said polystyrene/polyvinyl pyridine block copolymer possesses symmetry.

32. A photoconductive imaging member in accordance with claim 31 wherein the said block copolymer contains from 80 to 20 weight percent of 4-vinyl pyridine and said copolymer has a weight average molecular weight in the range of 8,000 to 35,000.

33. A photoconductive imaging member consisting essentially of a supporting substrate, a photogenerating layer comprised of photogenerating pigments dispersed in a polystyrene/polyvinyl pyridine ($A_n$–$B_m$) block copolymer with a weight average molecular weight of from about 10,500 to about 30,000 and a number average molecular weight of from about 8,000 to about 25,000, wherein n represents the degree of polymerization of A and m represents the degree of polymerization of B, and a charge transport layer.

34. A photoconductive imaging member in accordance with claim 33 wherein the photogenerating layer is comprised of a mixture of bisbenzimidazo(2,1 -a:1',2'-b')anthra(2,1,9-def:6,5,10-d',e',f') diisoquinoline-6,11-dione and bisbenzimidazo(2,1-a:2', 1,'-a)anthra(2,1,9-def:6,5,10-d',e',f')diisoquinoline-10,21-dione.

* * * * *